United States Patent [19]

Off et al.

[11] Patent Number: 4,690,078

[45] Date of Patent: Sep. 1, 1987

[54] METHOD AND APPARATUS FOR FORMING AND STITCHING A SHIRT PLACKET

[75] Inventors: Joseph W. A. Off, Irving; Vivian Ferguson, Dallas, both of Tex.

[73] Assignee: Automated Machinery Systems, Richmond, Va.

[21] Appl. No.: 909,693

[22] Filed: Sep. 19, 1986

[51] Int. Cl.[4] ..... D05B 21/00; A41H 33/00

[52] U.S. Cl. ..... 112/121.12; 112/121.15; 223/38

[58] Field of Search ..... 223/37, 38; 112/121.15, 112/121.12, 121.11, 262.3, 120, 147

[56] References Cited

U.S. PATENT DOCUMENTS

| | | | |
|---|---|---|---|
| 3,664,283 | 5/1972 | McFalls | 223/38 X |
| 4,117,790 | 10/1978 | Hasegawa et al. | 112/121.15 X |
| 4,160,423 | 7/1979 | Scholl et al. | 112/121.12 |
| 4,498,404 | 2/1985 | Sadeh | 112/121.15 |
| 4,602,580 | 7/1986 | Schramayr | 223/38 X |

*Primary Examiner*—Werner H. Schroeder
*Assistant Examiner*—J. L. Olds
*Attorney, Agent, or Firm*—Michael A. O'Neil

[57] ABSTRACT

A method for folding and stitching a shirt placket uses a remote placket forming assembly to facilitate formation of a shirt placket while a previously-formed placket is being stitched. To provide this operation, a transfer arm assembly supports the placket forming assembly at a location remote from the sewing machine of the apparatus. Following the formation of a placket on a first workpiece, the transfer arm assembly clamps and delivers the first workpiece to the sewing machine. Thereafter, the placket is clamped into a working position, and the transfer arm assembly is returned to its original position to receive a second workpiece. As the transfer arm assembly is returned, the sewing machine is actuated to stitch the previously-formed placket.

12 Claims, 9 Drawing Figures

METHOD AND APPARATUS FOR FORMING AND STITCHING A SHIRT PLACKET

TECHNICAL FIELD

The present invention relates generally to garment construction and particularly to an improved method and apparatus for forming and stitching a shirt sleeve placket.

BACKGROUND OF THE INVENTION

Machines for producing shirt sleeve plackets are known in the prior art. These machines typically include a sewing machine having a sewing clamp. In operation, a machine operator manually folds the sleeve in a predetermined manner to form the placket and thereafter manually positions the placket under the sewing clamp. The sewing machine is then actuated to stitch the sleeve placket.

Prior art techniques for forming sleeve plackets have several disadvantages. First, a great deal of expertise is required by the machine operator in order to fold the sleeve into the proper form prior to stitching of the placket. Although there have been attempts to design apparatus to facilitate the placket folding process, e.g., U.S. Pat. No. 3,664,283 to McFalls, such prior art techniques have produced less than satisfactory results. Moreover, because such techniques require the operator to both form and align the placket under the sewing clamp, each sleeve must be individually produced. This process is both time consuming and expensive, thereby decreasing the production rate of finished garments.

There is therefore a need for an improved method and apparatus for forming and stitching a sleeve placket which overcomes these and other limitations of prior art techniques.

BRIEF SUMMARY OF THE INVENTION

The present invention is directed to an improved placket forming and stitching apparatus which allows formation of a shirt placket by a machine operator while a previously-formed placket is being stitched.

In the preferred embodiment, the placket forming and stitching apparatus includes a base having a pivot axis and first and second longitudinal axes located in the plane of the base and intersecting the pivot axis, the second longitudinal axis being offset from the first longitudinal axis by a predetermined angle. A programmable sewing machine is mounted on the base and includes a placket clamp located along the second longitudinal axis. The apparatus also includes a transfer arm assembly having a first end attached to the base at the pivot axis and a second end for supporting a placket forming assembly. The placket forming assembly receives a workpiece on which a placket will be formed while the transfer arm assembly is located along the first longitudinal axis. After the placket has been formed by the operator, the workpiece is clamped in the transfer arm assembly by a clamping assembly. Thereafter, the transfer arm assembly and the workpiece are rotated about the pivot axis between the first longitudinal axis and the second longitudinal axis to thereby locate the workpiece under the clamp plate of the sewing machine. Following actuation of the clamp plate, the clamping assembly is released and the transfer arm assembly is rotated back to its original position along the first longitudinal axis to receive another workpiece. The sewing machine is actuated to stitch the previously-formed placket as the transfer arm assembly is returned.

BRIEF DESCRIPTION OF THE DRAWINGS

For a more complete understanding of the present invention and the advantages thereof, reference is now made to the following Description taken in conjunction with the accompanying Drawings in which.

DETAILED DESCRIPTION

Figure 1:
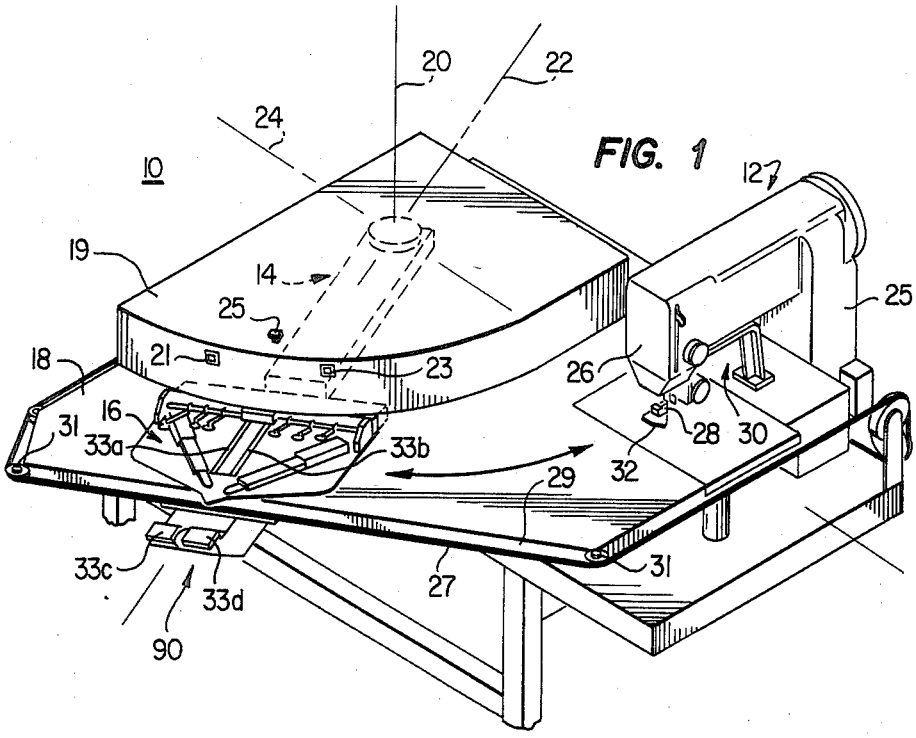
FIG. 1 is a perspective view of the placket forming and stitching apparatus of the present invention having a programmable sewing machine and a transfer arm assembly.

Referring now to the drawings wherein like reference characters designate like or similar parts throughout the several views, FIG. 1 is a perspective view of the placket forming and stitching apparatus 10 of the present invention. Apparatus 10 includes three primary components: a programmable sewing machine 12, a transfer arm assembly 14 and a placket forming assembly 16. Placket forming assembly 16 is supported by transfer arm assembly 14 and functions to receive a workpiece (e.g. a shirt sleeve) to facilitate formation of a placket by an operator.

The placket forming and stitching apparatus 10 includes a table or base 18 having a pivot axis 20 and a first longitudinal axis 22 located in the plane of the base 18 and intersecting the pivot axis 20. The apparatus 10 also includes a second longitudinal axis 24 located in the plane of the base 18 and offset from the first longitudinal axis 22 by a predetermined angle. The precise location of the pivot axis 20 and the longitudinal axes 22 and 24 shown in FIG. 1 are not meant to be limiting as other orientations of the components of the apparatus 10 may be used. The programmable sewing machine 12 has a base 25 and a conventional sewing mechanism 26. As is well known, sewing mechanism 26 includes a sewing needle 28 which is vertically reciprocated by the sewing mechanism 26 via a drive mechanism (not shown) within the machine. Programmable sewing machine 12 is of conventional design and includes an electronic control system for driving the sewing needle 28 in a manner to provide a variety of stitchlines, e.g., straight, zig-zag and "E" stitches. Electronic control system includes a suitable microprocessor and associated memory devices for storing computer programs which control the operation of the sewing mechanism 26. In the preferred embodiment, the programmable sewing machine 12 is a Mitsubishi Model POK-0604 (or Model POK-0303). Programmable sewing machine 12 also includes a clamping assembly 30 having a placket clamp 32. The placket clamp 32 has a cross-sectional area slightly smaller than the placket to be formed and is located substantially along the second longitudinal axis 24.

The apparatus 10 includes a hinged cover 19 for substantially enclosing the transfer arm assembly 14. Cover 19 supports a pair of control switches 21 and 23 on a front surface thereof and supports an emergency stop switch 25 on a top surface thereof. As will be described in more detail below, rotation of the transfer arm assembly 14 about the pivot axis 20 is preferably controlled by depression of one or both of the control switches 21 and 23. Switch 25 is used to totally disable the apparatus 10 should the need arise. As also seen in FIG. 1, the base 18 may support a placket transfer mechanism comprising a closed loop flexible tube or the like 27 supported for movement along the outer front periphery 29 of the base 18 by supports 31. The flexible tube 27 is driven along the front periphery 29 of the base 18 by a suitable drive mechanism (not shown) to facilitate transfer of the workpiece along the periphery during operation of the apparatus.

As also seen in FIG. 1, the apparatus includes various guides to facilitate formation of a placket by the operator. Specifically, the transfer arm assembly 14 includes guides 33*a* and 33*b*. The apparatus also includes guides 33*c* and 33*d* mounted on a control switch assembly 90 to be described.

Figure 2:
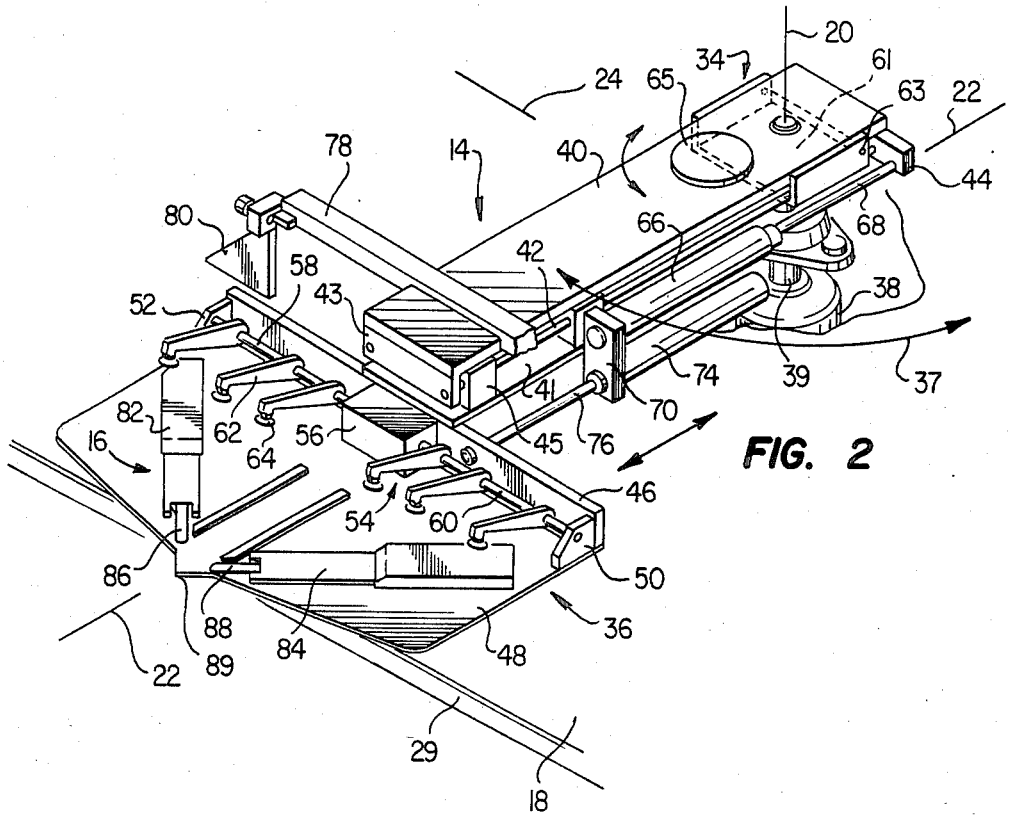
FIG. 2 is a detailed perspective view of the transfer arm assembly of FIG. 1 showing the placket forming assembly of the invention supported thereby in its extended position.

Referring now to FIG. 2, a detailed perspective view is shown of the transfer arm assembly 14. Generally, transfer arm assembly 14 serves to isolate the placket forming operation from the placket stitching operation by supporting the placket forming assembly 16 at a location remote from the placket clamp 32 of the sewing machine 12. As will be described, a placket is formed in a workpiece while the transfer arm assembly is located along the first longitudinal axis 22. Thereafter, the workpiece (having the placket formed therein) is transferred to the second longitudinal axis 24 by rotation of the transfer arm assembly 14 about the pivot axis 20 to locate the placket under the placket clamp 32. Transfer of the workpiece is facilitated by the moving flexible tube 27 as described above with respect to FIG. 1.

The transfer arm assembly 14 has a first end 34 and a second end 36, the first end 34 attached to the base 18 for rotation about the pivot axis 20. Rotation of the transfer arm assembly 14 facilitates the transfer (as represented by arrow 37) of the workpiece to the programmable sewing machine 12. As also seen in FIG. 2, a suitable drive mechanism 38 is supported under the base 18 for rotating the transfer arm assembly 14 about the pivot axis 20 between the first longitudinal axis 22 and the second longitudinal axis 24. Drive mechanism 38, which includes an air cylinder and bearing mechanism to provide rotation of shaft 39, is controlled by control switches 21 and 23 of FIG. 1. As described above, rotation of the transfer arm assembly 14 locates the workpiece under the placket clamp 32 of the programmable sewing machine 12. As will be described, the placket clamp 32 is then actuated to clamp the placket and the transfer arm assembly 14 is returned back to its original position to receive another workpiece.

As seen in FIG. 2, the placket forming assembly 16 is supported on the second end 36 of the transfer arm assembly 14. Specifically, transfer arm assembly 14 includes first and second longitudinal members 40 and 41. The first longitudinal member 40 supports a pair of support rods 42 along its length between support members 43 and 44. The second longitudinal member 41 supports a slide member 45 which slides along the fixed support rods 42 to enable the second longitudinal member 41 to reciprocate along the length of the transfer arm assembly 14 in a manner to be described. The second longitudinal member 41 also supports a first transverse member 46, which is supported at its ends by a support plate 48 via end brackets 50 and 52. The first transverse member 46 and the support plate 48 support a clamping assembly 54 of the transfer arm assembly 14 comprising a rotary actuator 56 and support rods 58 and 60. Each of the support rods 58 and 60 supports one or more clamping members 62 and each such clamping member 62 includes a plastic cup or the like 64 at its distal end. As will be described, the rotary actuator 56 is actuated by a suitable pneumatic control system to rotate the clamping members 62 and their respective cups 64 to thereby clamp a workpiece against the support plate 48 of the transfer arm assembly 14 prior to rotation of the transfer arm assembly. Preferably, the clamping assembly 54 is actuated by a foot switch or the like. Moreover, the structure and placement of the clamping members 62 as shown in FIG. 2 is not meant to be limiting. For example, an additional (central) clamping member may be provided to clamp the placket itself, and one or more of the members may extend to the edge of support plate 48 to firmly clamp the workpiece as the transfer arm assembly is rotated.

The first longitudinal member 40 is also adapted for pivotal movement with respect to a hinge plate 61 which is secured to shaft 39. Specifically, first longitudinal member 40 is secured to the hinge plate 61 along a pivot shaft 63. An air cylinder 65 mounted on the member 40 includes an actuator (not shown) which pushes against the hinge plate 61 to thereby lift the member 40 about the pivot shaft 63. This operation is controlled by the same control means used to actuate the clamping assembly 54 which clamps the workpiece in the placket forming assembly. The lifting of the first longitudinal member 40 in this manner facilitates the smooth transfer of the workpiece to the sewing machine 12.

As also seen in FIG. 2, the transfer arm assembly 14 includes a suitable mechanism for respectively extending and retracting the support plate 48 and thus the placket forming assembly 16 prior to and after the formation of the packet. In particular, transfer arm assembly 14 includes a first air actuator, comprising cylinder 66 and piston rod 68, mounted along the first longitudinal member 40 between support members 70 and 44. A second air actuator, comprising cylinder 74 and piston rod 76, is also mounted along the first longitudinal member 40 between the support member 70 and the first transverse member 46. Cylinders 66 and 74 cooperate to reciprocate the second longitudinal member 41 along the fixed support rods 42. The back-to-back placement of the cylinders 66 and 74 as shown in FIG. 2 allows the placket forming assembly 16 to be extended approximately twice as far as would be possible with just a single limited-stroke cylinder. Transfer arm assembly 14 also includes a second transverse member 78, partially cutaway, fixed to the first longitudinal member 40. The second transverse member 78 cooperates with an end stop member 80 secured to the base 18 to limit the movement of the transfer arm assembly as this assembly is returned back to the first longitudinal axis. Although not shown in detail, it should be appreciated that another end stop member is also placed adjacent the second longitudinal axis 24. This end stop member includes a limit switch or the like which is triggered by the second transverse member 78 as transfer arm assembly 14 transfers the workpiece to the sewing machine.

In operation, the support plate 48 and the placket forming assembly 16 are extended between a retracted position and an extended position along the first longitudinal axis 22 during the initial placket forming cycle. This "extended" position is shown in FIG. 2. Following the movement of the transfer arm assembly 14 to its position along the second longitudinal axis 24, the support plate 48 and the placket forming assembly 16 are retracted. The transfer arm assembly 14 is then returned back to the first longitudinal axis 24.

As seen in FIG. 2, the placket forming assembly 16 is preferably supported on the support plate 48 of the transfer arm assembly 14. Placket forming assembly 16 comprises first and second folder blade assemblies 82 and 84. First folder blade assembly 82 includes a blade 86 adapted to be extended between a retracted position within the first folder blade assembly 82 and an extended position partially overlapping the first longitudinal axis 22. Likewise, second folder blade assembly 84 includes a blade 88 adapted to be extended between a retracted position within the second folder blade assembly 84 and an extended position partially overlapping the first longitudinal axis 22. During formation of a placket by an operator, only one of the blades 86 or 88 will be extended. For example, blade 86 of the first folder assembly 82 is extended to form a placket for a "left" sleeve; likewise, blade 88 of the second folder blade assembly 84 is extended when the operator desires to form a placket for a "right" sleeve. Once production begins, blades 86 and 88 are normally sequentially extended to enable the operator to alternatively form "left" and "right" plackets. This operation can be overridden (by a suitable control switch) to allow the operator to produce just "left" or "right" plackets if desired.

Referring back to FIG. 1, the placket forming and stitching apparatus 10 includes a control switch assembly 90 mounted under the base 18 for controlling the initial operation of the placket forming assembly 16. As will be described, control switch assembly 90 includes a switch which is depressed by the operator's proper placement of a workpiece in the placket forming assembly 16. Depression of the switch causes two important events to occur: (a) actuation of cylinders 66 and 74 to thereby reciprocate the second longitudinal member 41 along the support rods 42 to drive the placket forming assembly 16 to its extended position of FIG. 2, and (b) extension of one of the blades 86 or 88 of the folder blade assemblies.

Figure 3:
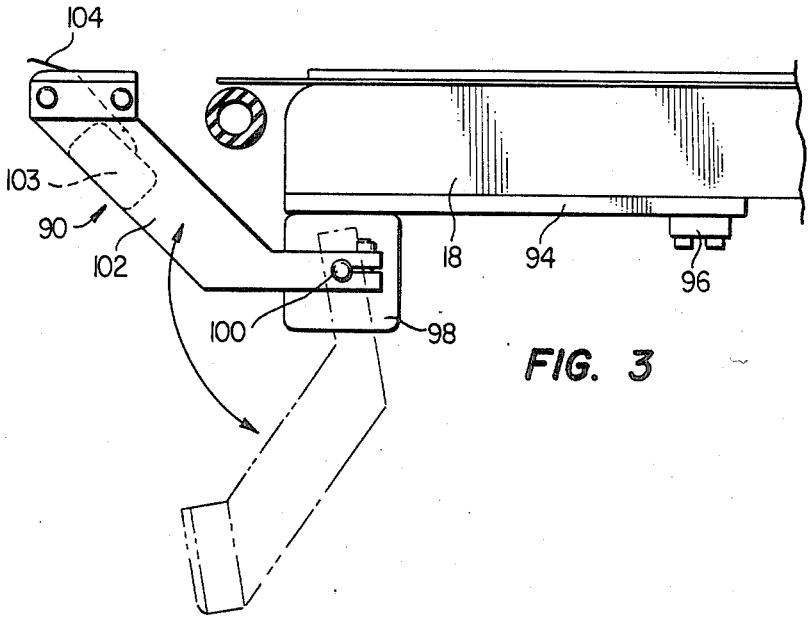
FIG. 3 is a side view of a control switch assembly of the invention for controlling the initial operation of the placket forming assembly of FIG. 2.

Referring now to FIG. 3, a side view is shown of the control switch assembly 90 of FIG. 1. Control switch assembly 90 includes a support base 94 secured to the underside of the base 18 by fastener 96. Support base 94 supports a rotary actuator 98 having a pair of rotating piston rods, one of which is shown as 100. The piston rods 100 support a rotatable support bracket 102 which in turn supports a microswitch 103 having a control element 104. In operation, depression of the control element 104 actuates the microswitch 103, in turn controlling the rotary actuator 98 to rotate the rotatable support bracket 102 downward as shown in phantom in FIG. 3. As discussed above, actuation of the microswitch 103 also causes one of the blades 86 or 88 to be extended, and actuates cylinders 66 to 74 to extend the placket forming assembly 16 to a working position.

Figure 4:
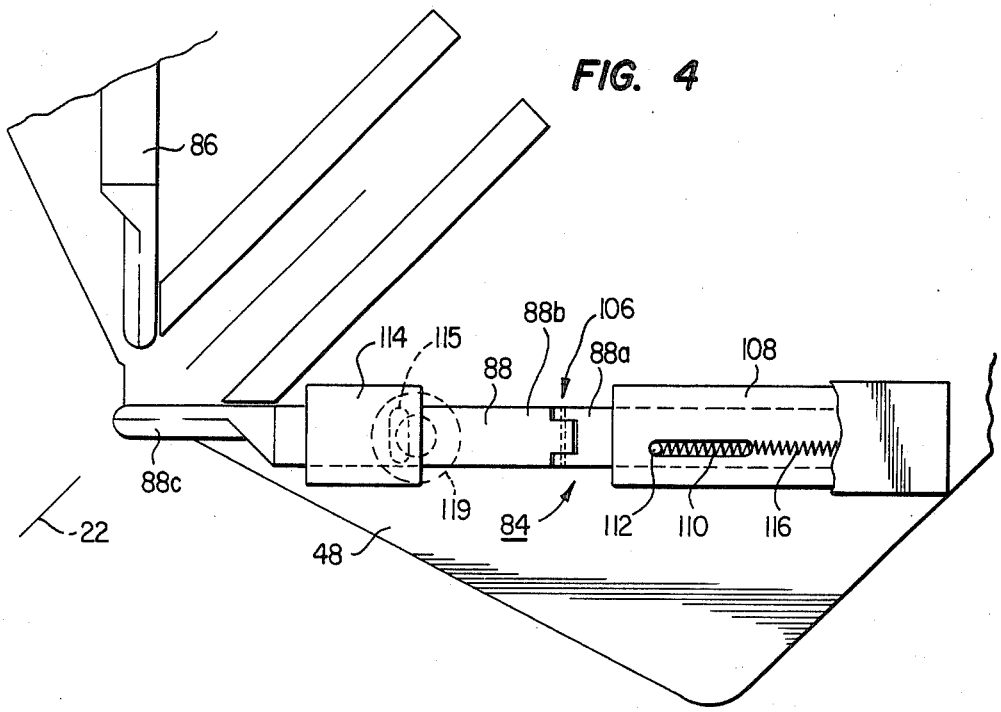
FIG. 4 is a top view of one of folder blade assemblies of the placket forming assembly.

Referring now to FIG. 4, a top view is shown of the second folder blade assembly 84 of the placket forming assembly 16. As described above, assembly 84 supports the blade 88 for movement between a retracted position and an extended position as shown in FIG. 4. Blade 88 includes three sections: a back section **88*a*, a middle section 88*b* connected to the back section 88*a* by a hinge 106, and a front section 88*c* secured to the middle section 88*b*. The back section 88*a* is supported in a back housing 108 and includes a slide aperture 110 which cooperates with pin 112 to enable the back section 88*a* to be reciprocated horizontally as will be described. The middle section 88*b* is partially enclosed in housing 114 and is supported for vertical movement about the hinge 106. A spring 116, secured at one end to the back housing 108 and at the other end to pin 112, is provided to bias the blade 88 for horizontal movement from its extended position to its retracted position following the formation of the placket as will be described. The middle section 88*b* of the blade 88 includes a semi-circular aperture 115 in its top surface and a substantially circular aperture 119** in its bottom surface.

Figure 5:
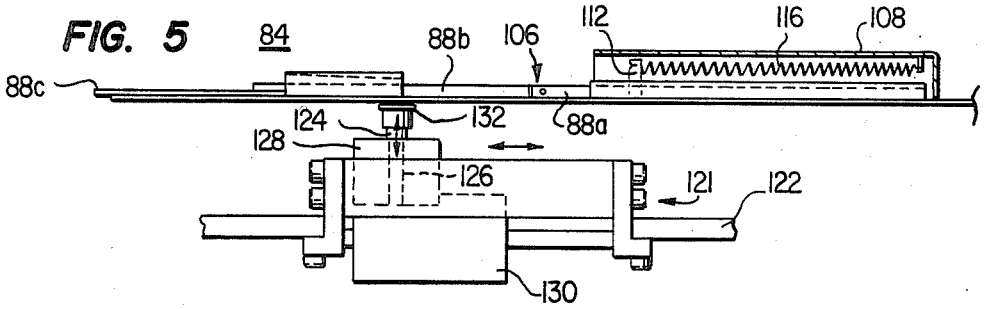
FIG. 5 is a side view of the folder blade assembly of FIG. 4 along with its associated drive mechanism for extending a blade therein.

Referring now to FIG. 5, a side view is shown of the second folder blade assembly 84 of FIG. 4 along with its associated drive mechanism 121 for extending and retracting the blade 88. Although not shown in detail, it should be appreciated that the first folder blade assembly 82 has a similar structure and drive mechanism. Drive mechanism 121 is supported on a support plate 122 and includes a control member 124 supported on post 126. Post 126 is adapted for vertical reciprocation through an aperture in the base 18 and the aperture 119 in the bottom surface by a vertical pneumatic actuator 128. Post 126 is also adapted for horizontal reciprocation by a horizontal pneumatic actuator 130. Control member 124 includes a lip portion 132 for the purposes to be described.

Figure 6:
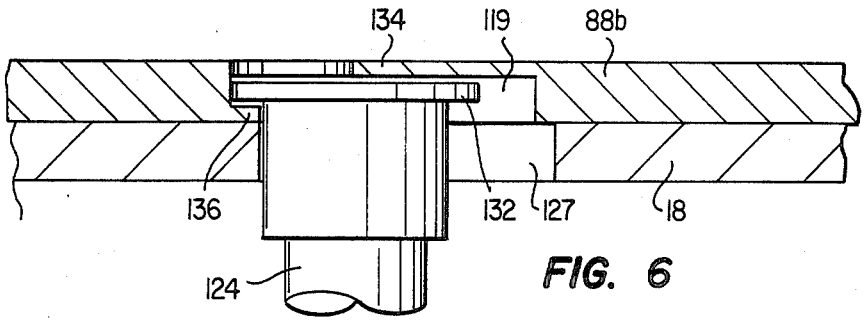
FIG. 6 is a detailed view of the control member of the drive mechanism of FIG. 5 used to extend and retract the blade of the folder blade assembly.

Specifically FIG. 6 shows a detailed view of the control member 124 and how this member interacts with the middle section **88*b* of the blade 88 to extend and retract the blade. Upon actuation of the microswitch 103 as discussed above, vertical actuator 128 drives the control member 124 upwards through aperture 127 in the base 18 and aperture 119 in the member 88*b*. The lip portion 132 of the control member 124 then engages a lip portion 134 of the top surface of the blade member 88, thereby driving the middle section 88*b* upwards. Thereafter, the horizontal actuator 130 is actuated to drive the raised middle section 88*b* in a forward (horizontal) direction as seen in FIG. 6. This operation causes the back section 88*a* to reciprocate horizontally along the pin 112 and the (raised) front section 88*c* to be drawn over the edge of the workpiece. The movement of the front section 88*c* places the blade in its extended position partially overlapping the first longitudinal axis 22. Upon completion of the stroke of the horizontal actuator 130, the vertical actuator 128 is driven in the opposite direction, thereby pulling the lip portion 132 of the control member 124 downward to engage a lip portion 136 of the bottom surface 120. This operation clamps the blade 88** in the extended position.

Figure 8A:
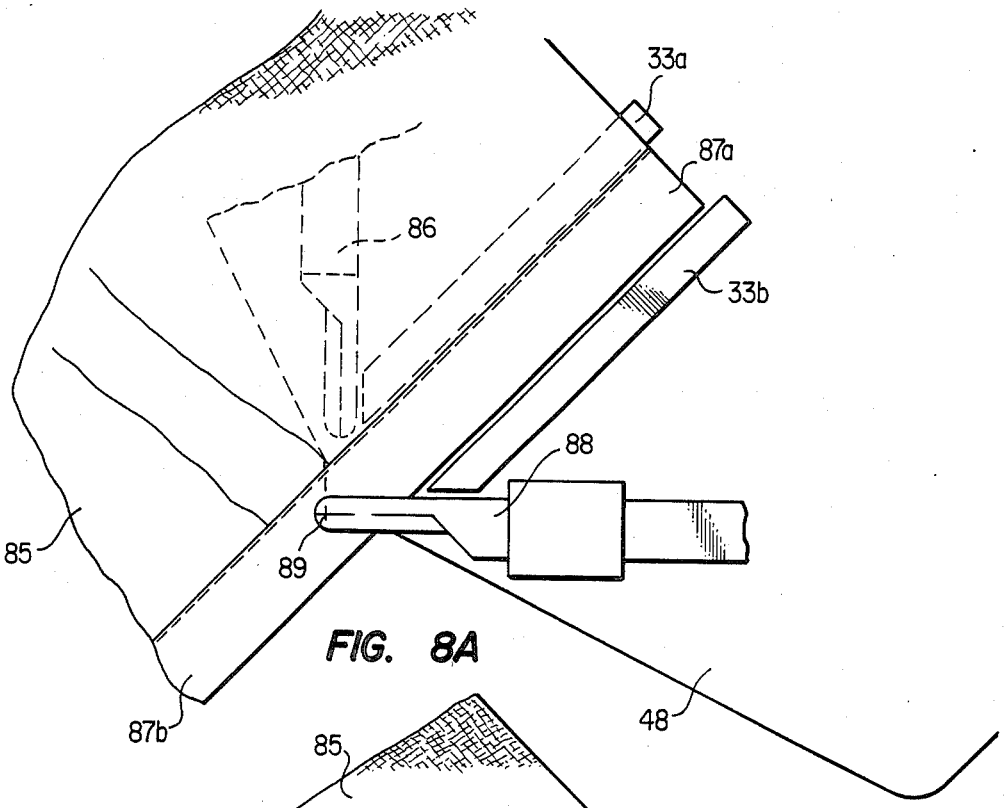
FIG. 8A and 8B are top views of the placket forming assembly showing how a placket is formed in a workpiece according to the invention.
Figure 8B:
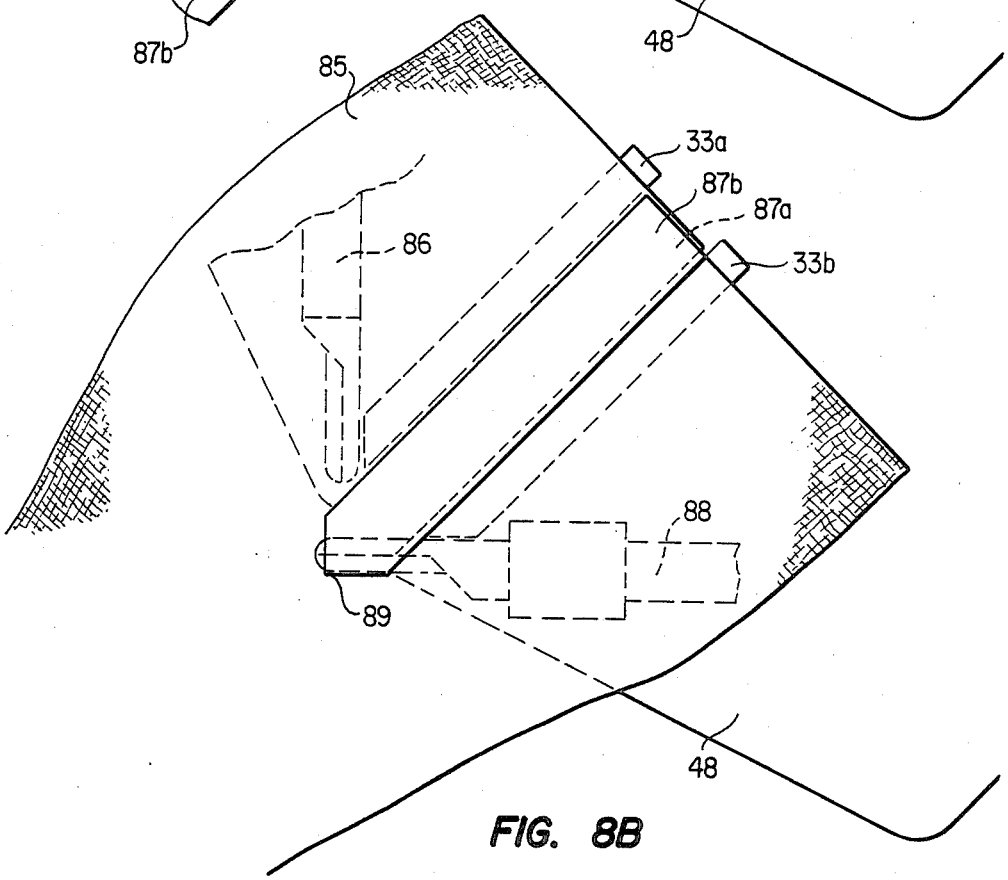

A "right" placket is formed on the workpiece 85 by the operator in the following manner. With reference to FIG. 8A, the operator begins by holding both first and second ends 87*a* and 87*b* of the placket in a straight line. Next the operator places the first end 87*a* of the placket between guides 33*a* and 33*b* and places the second end 87*b* over control element 104 and between guides 33*c* and 33*d*. This operation centers the placket on a folding point 89 of the plate 48. Upon depression of element 104, microswitch 103 is actuated causing blade 88 to move up, forward and down to clamp the placket. As discussed above, actuation of microswitch 103 also rotates the support bracket 102. The operator then holds the first end 87*a* of the placket between guides 33*a* and 33*b* while pulling the second end 87*b* of the placket down approximately 75°. Thereafter, the second end 87*b* is rotated in a counterclockwise direction about the folding point 89 until the placket is up and directly above the folding point. The second end 87*b* is then placed down between guides 33*a* and 33*b* as shown in FIG. 8B. The operator then smoothes out the workpiece 85.

Following the placket forming operation, the operator depresses a control switch, e.g. a foot switch, which causes three separate events to occur: (a) actuation of the clamping assembly 54 to clamp the workpiece in the transfer arm assembly 14, (b) actuation of air cylinder 65 to pivot member 40 about shaft 63, and (c) retraction of whichever blade 86 or 88 was extended to facilitate formation of the placket in the workpiece. To this end, horizontal actuator 130 is driven to a neutral (no air) position, causing the post 126 to begin to retract the (raised) back member 88*a*. The vertical actuator 128 is then actuated to remove the post 126 from the folder blade assembly through the aperture 127. After the post 126 is removed, the blade 88 is fully drawn back into its retracted position within the folder blade assembly by spring 116.

Referring back to FIG. 1, the transfer arm assembly 14 is then rotated about the pivot axis 20 from its original position along the first longitudinal axis 22 to a second position along the second longitudinal axis 24. This rotation places the placket substantially underneath the placket clamp 32 of the sewing machine 12. As the transfer arm assembly 14 reaches the programmable sewing machine 12, the second transverse member 78 actuates the limit switch supported in the end stop member positioned adjacent the second longitudinal axis 24. This operation actuates the clamping assembly 30 of the sewing machine 12 to drive the placket clamp 32 against the placket. The clamping assembly 54 of the transfer arm assembly 14 is then automatically released and the cylinders 66 and 74 are reversed to return the placket forming assembly 16 to its retracted position. Thereafter, the transfer arm assembly 14 is returned from its position along the second longitudinal axis 24 to its original position along the first longitudinal axis 22 via reversal of the drive mechanism 38. As the transfer arm assembly 14 is returned to its original position to receive another workpiece, the programmable sewing machine 12 is actuated to stitch the previously-formed placket.

Figure 7:
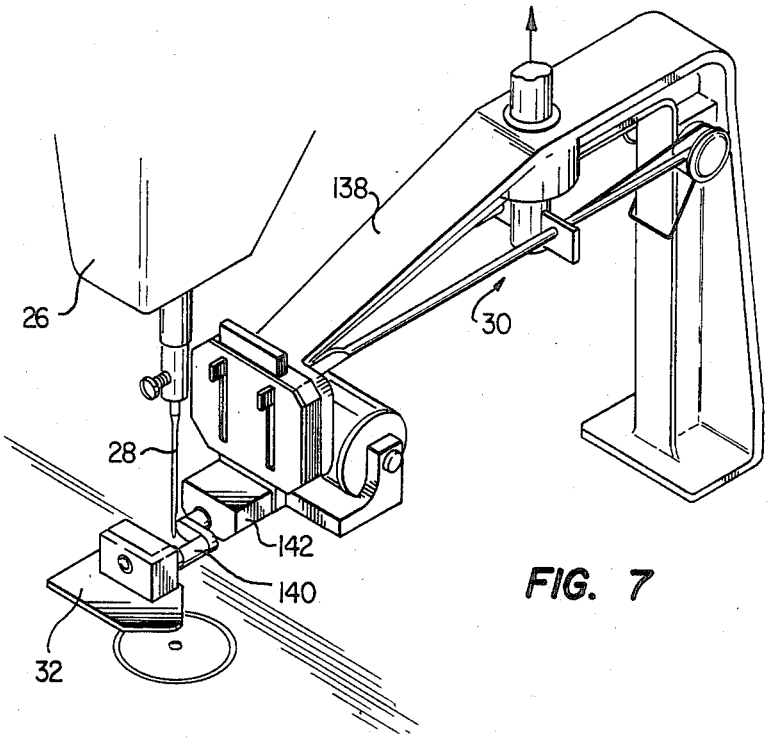
FIG. 7 is a detailed perspective view of the clamping assembly of the programmable sewing machine of FIG. 1 used to clamp the placket following transfer of the workpiece by the transfer arm assembly.

Referring now to FIG. 7, a detailed perspective view is shown of the clamping assembly 30 of the sewing machine 12. Clamping assembly 30 includes a clamp arm 138 which is actuated to drive the placket clamp 32 against the placket. The placket clamp 32 is secured to the clamp 138 via a U-shaped shaft 140 and support 142. Shaft 140 is rotated 180° near the end of the sewing cycle by a suitable rack and pinion mechanism within the support 142 to enable the placket stitch pattern to be completed. Clamping assembly 30 is otherwise conventional.

Although not shown in detail, it should be appreciated that the apparatus 10 incorporates a suitable pneumatic control system which is responsive to the various control switches described to carry out the actuation and de-actuation of the various pneumatic cylinders and actuators described above.

It can be seen that the placket forming and stitching apparatus of the present invention is advantageous because it uses a remote placket forming assembly to facilitate formation of a shirt placket while a previously-formed placket is being stitched. This operation is provided via the transfer arm assembly which supports the placket forming assembly at a location remote from the sewing machine. The apparatus significantly reduces operator training time and significantly increases the production rate of finished garments by allowing substantially simultaneous formation and stitching of plackets.

Although the invention has been described in detail, it is to be clearly understood that the same is by way of illustration and example only and is not to be taken by way of limitation, the spirit and scope of the invention being limited only to the terms of the appended claims.

We claim:

1. An apparatus for folding and stitching a placket, comprising:

a base having a pivot axis and first and second longitudinal axes located in the plane of the base and intersecting the pivot axis, the second longitudinal axis offset from the first longitudinal axis by a predetermined angle;

a sewing machine mounted on the base and having means for clamping and stitching a placket;

a transfer arm assembly having a first end and a second end, the first end attached to the base at the pivot axis;

a placket forming assembly supported on the second end of the transfer arm assembly for receiving a workpiece to be formed into a placket while the transfer arm assembly is located along the first longitudinal axis;

means supported by the base for rotating the transfer arm assembly and the workpiece about the pivot axis following formation of the placket between the first longitudinal axis and the second longitudinal axis to locate the placket along the second longitudinal axis;

means responsive to the rotating means for actuating the clamping and stitching means of the sewing machine to stitch the placket;

a clamping assembly supported on the second end of the transfer arm assembly for clamping the workpiece prior to rotating the transfer arm assembly;

a control switch for actuating the clamping assembly to clamp the placket in the transfer arm assembly; and means responsive to the control switch for extending the placket forming assembly between a retracted position and an extended position along the first longitudinal axis to facilitate formation of the placket.

2. The apparatus for folding and stitching a placket as described in claim 1 further including:

means responsive to the clamping means of the sewing machine for rotating the transfer arm assembly between the second longitudinal axis and the first longitudinal axis to receive another workpiece.

3. The apparatus for folding and stitching a placket as described in claim 1 wherein the means responsive to the clamping means further includes:

means for retracting the placket forming assembly from the extended position to the retracted position prior to rotating the transfer arm assembly between the second longitudinal axis and the first longitudinal axis.

4. An apparatus for folding and stitching a placket, comprising:

a base having a pivot axis and first and second longitudinal axes located in the plane of the base and intersecting the pivot axis, the second longitudinal axis offset from the first longitudinal axis by a predetermined angle;

a sewing machine mounted on the base and having means for clamping and stitching a placket;

a transfer arm assembly having a first end and a second end, the first end attached to the base at the pivot axis;

first and second folder blade assemblies each supported on the base and having a blade adapted to be extended between a retracted position within the respective folder blade assembly and an extended position partially overlapping the first longitudinal axis;

means supported by the base for rotating the transfer arm assembly and the workpiece about the pivot axis following formation of the placket between the first longitudinal axis and the second longitudinal axis to locate the placket along the second longitudinal axis; and means responsive to the rotating means for actuating the clamping and stitching means of the sewing machine to stitch the placket.

5. The apparatus for folding and stitching a placket as described in claim 4 further including:

means supported under the base for sequentially extending the blades of the folder blade assemblies to facilitate formation of the placket.

6. The apparatus for folding and stitching a placket as described in claim 5 further including:

means supported by the base for actuating the extending means to thereby sequentially extend the blades of the folder blade assemblies.

7. The apparatus for folding and stitching a placket as described in claim 6 further including:

means for retracting the blades of the folder blade assemblies subsequent to formation of the placket.

8. An apparatus for folding and stitching a placket, comprising:

a base having a pivot axis and first and second longitudinal axes located in the plane of the base and intersecting the pivot axis, the second longitudinal axis offset from the first longitudinal axis by a predetermined angle;

a programmable sewing machine mounted on the base and having a placket clamp and means for stitching the placket, the placket clamp located along the second longitudinal axis;

a transfer arm assembly having a first end and a second end, the first end attached to the base at the pivot axis;

a placket forming assembly supported on the second end of the transfer arm assembly for receiving a workpiece to be formed into a placket while the transfer arm assembly is located along the first longitudinal axis, the placket forming assembly including first and second folder blade assemblies each supported on the base and having a blade adapted to be extended between a retracted position within the respective folder blade assembly and an extended position partially overlapping the first longitudinal axis;

means supported under the base for sequentially extending the blades of the folder blade assemblies to facilitate formation of the placket;

means supported by the base for rotating the transfer arm assembly and the workpiece about the pivot axis following formation of the placket between the first longitudinal axis and the second longitudinal axis to locate the workpiece under the placket clamp; and means responsive to the rotating means for actuating the means for stitching the placket.

9. The apparatus for folding and stitching a placket as described in claim 8 further including:

means responsive to the placket clamp for rotating the transfer arm assembly between the second longitudinal axis and the first longitudinal axis to receive another workpiece.

10. The apparatus for folding and stitching a placket as described in claim 8 further including:

means supported by the base for actuating the extending means to thereby sequentially extend the blades of the folder blade assemblies.

11. The apparatus for folding and stitching a placket as described in claim 10 further including:

means for retracting the blades of the folder blade assemblies subsequent to formation of the placket.

12. A method for folding and stitching a placket in a workpiece using a programmable sewing machine, comprising the steps of:

(a) placing a first workpiece in a placket forming assembly supported along a first longitudinal axis;

(b) extending the placket forming assembly from a first position to a second position along the first longitudinal axis;

(c) forming a placket in the first workpiece;

(d) clamping the first workpiece in the placket forming assembly following formation of the placket;

(e) rotating the placket forming assembly about a pivot axis from the first longitudinal axis to a second longitudinal axis offset from the first longitudinal axis by a predetermined angle;

(f) clamping the first workpiece in a predetermined position in the programmable sewing machine;

(g) releasing the first workpiece clamped in the placket forming assembly in step (d);

(h) retracting the placket forming assembly from the second position to the first position;

(i) rotating the placket forming assembly about the pivot axis from the second longitudinal axis to the first longitudinal axis;

(j) stitching the placket in the first workpiece as the placket forming assembly is returned to the first longitudinal axis; and (k) repeating steps (a)–(j) for a second workpiece.

* * * * *